US006195857B1

(12) United States Patent
Chang et al.

(10) Patent No.: US 6,195,857 B1
(45) Date of Patent: Mar. 6, 2001

(54) AUTOMATED DEVICE AND METHOD FOR STRIPPING RESIDUAL YARN FROM YARN TUBE

(75) Inventors: Lung-Wu Chang; Shi-Ming Wang; Albert Day, all of Tainan; Chin-Lung Liu, Kaoshiung Hsien; Chien-Hua Li; Tzu-Yang Wang, both of Tainan, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/628,032

(22) Filed: Jul. 27, 2000

(51) Int. Cl.[7] ..... B65H 73/00
(52) U.S. Cl. ..... 28/295; 28/292
(58) Field of Search ..... 28/292, 294, 295, 28/296, 297, 298, 293; 139/224, 232 R, 232 B, 232 L, 261, 273 A; 57/281, 90, 300, 303, 305, 304, 306

(56) References Cited

U.S. PATENT DOCUMENTS

| | | | | |
|---|---|---|---|---|
| 3,112,550 | * | 12/1963 | Bentley | 28/295 |
| 3,928,899 | * | 12/1975 | Maiworm | 28/295 |
| 4,783,887 | * | 11/1988 | Trias | 28/292 |
| 4,936,086 | * | 6/1990 | Carter et al. | 57/304 |
| 4,970,764 | * | 11/1990 | Trias | 28/292 |
| 5,148,665 | * | 9/1992 | Kidani | 57/281 |
| 5,443,165 | * | 8/1995 | Hasui | 209/602 |
| 6,092,268 | * | 7/2000 | Mack | 28/292 |

* cited by examiner

*Primary Examiner*—Danny Worrell
(74) *Attorney, Agent, or Firm*—Browdy and Neimark

(57) ABSTRACT

A device is designed to automate the process of stripping residual yarn from a yarn tube. The device comprises a feeding mechanism, an index dial, a residual yarn removing mechanism, a compression mechanism, and an arranging mechanism. The automated device enhances the recycling quality of the stripped residual yarn and minimizes the likelihood that the yarn tube is damaged in the stripping process.

18 Claims, 7 Drawing Sheets

AUTOMATED DEVICE AND METHOD FOR STRIPPING RESIDUAL YARN FROM YARN TUBE

FIELD OF THE INVENTION

The present invention relates generally to the removal of residual yarn from the yarn tube, and more particularly to a device, and a method of using the device to remove residual yarn from the yarn tube.

BACKGROUND OF THE INVENTION

The conventional way of removing the residual yarn from the yarn tube involves the use of a cutter by an operator to separate manually the residual yarn from the yarn tube. Such a conventional way as described above is primitive at best. The surface of the yarn tube is susceptible to damage caused inadvertently by the operator in the course of cutting off the residual yarn. In addition, such a manual operation of stripping the residual yarn from the yarn tube is not cost-effective. Moreover, the dust of the yarn residue, especially the dust of the yarn of glass fiber, is a potential health hazard to the worker.

The residual yarn is generally recycled for making an instrument panel, a safety helmet, and the like. It is likely that a residual yarn is contaminated with the metal impurities in the course of the manual removal of the residual yarn. The residual yarn of a low purity is of a little value as far as the recycling of the residual yarn is concerned.

SUMMARY OF THE INVENTION

The primary objective of the present invention is to provide an automated device for removing the residual yarn from the yarn tube economically and efficiently. The automated device of the present invention eliminates the shortcomings of the conventional manual operation of removing the residual yarn from the yarn tube.

The automated device of the present invention comprises a feeding mechanism, an index dial, a residual yarn removing mechanism, a suction mechanism, and an arranging mechanism. The feeding mechanism of the present invention is designed to take in simultaneously a plurality of yarn tubes with residual yarn attached thereto. The index dial is provided with a plurality of clamping tools for holding the yarn tubes horizontally to facilitate the removing of the residual yarn from the yarn tube by the residual yarn removing mechanism. The yarn residue is removed by the suction mechanism. The stripped yarn tubes are arranged uprightly by the arranging mechanism for storage or transportation.

The feeding mechanism of the automated device of the present invention comprises a rotary tray, and a first mechanical arm. The rotary tray is used to receive the incoming yarn tubes, which are then transferred by the first mechanical arm to the clamping tools of the index dial. The arranging mechanism comprises a second mechanical arm and a conveyor. The stripped yarn tubes are arranged uprightly by the second mechanical arm before they are carried away by the conveyor.

BRIEF DESCRIPTION OF THE DRAWINGS

FIG. 9 shows a schematic view of a static removing mechanism of the preferred embodiment of the present invention.

FIG. 10 shows a schematic view of the suction mechanism of the preferred embodiment of the present invention.

FIG. 11 shows a top view of the second mechanical arm of the preferred embodiment of the present invention.

FIG. 12 shows a front view of the second mechanical arm of the preferred embodiment of the present invention.

FIG. 13 shows a side view of the second mechanical arm of the preferred embodiment of the present invention.

DETAILED DESCRIPTION OF THE INVENTION

Figure 1:
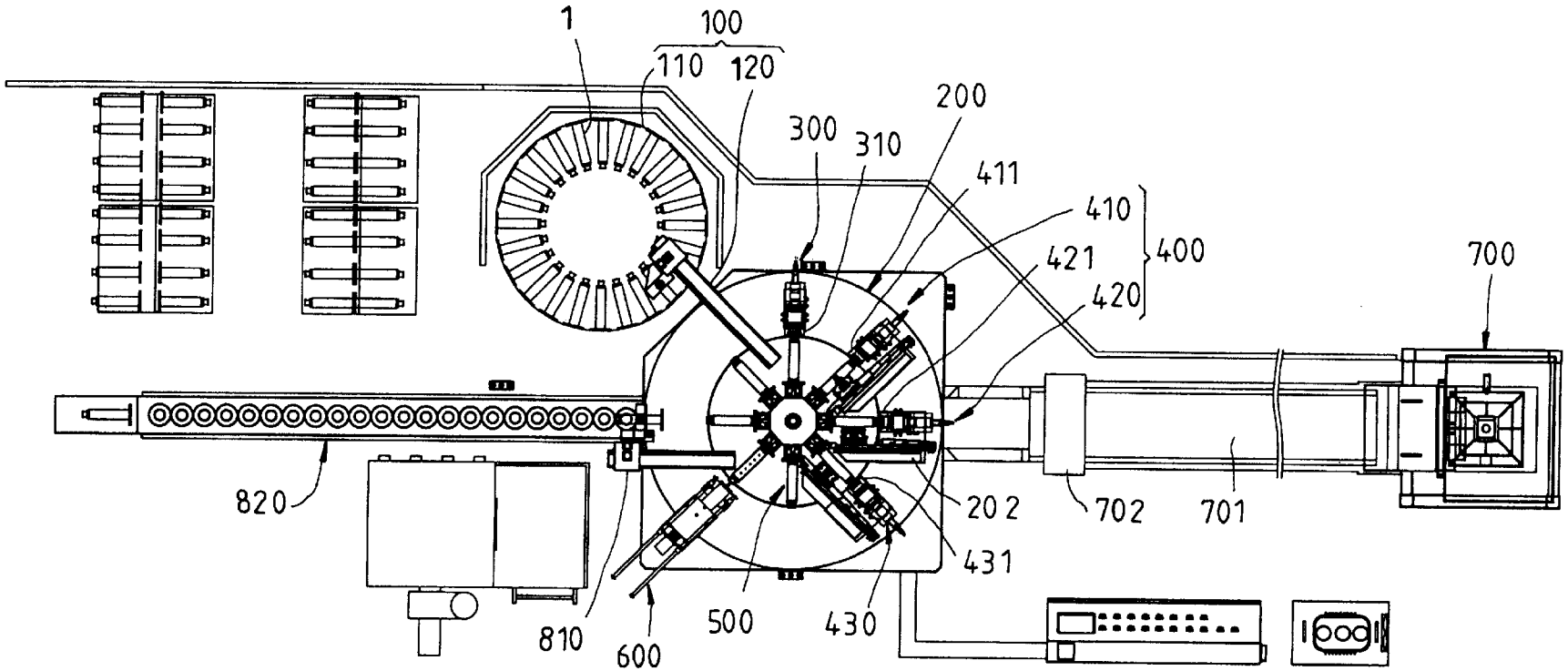
FIG. 1 shows a top view of a preferred embodiment of the present invention.
Figure 2:
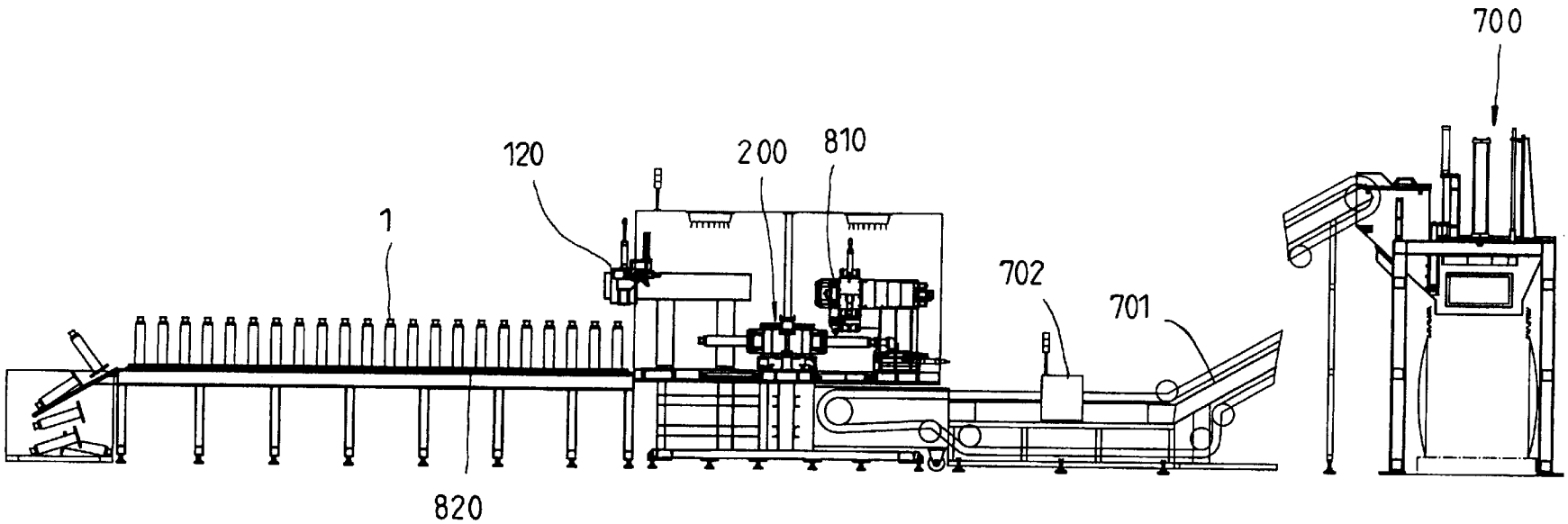
FIG. 2 shows a side view of the preferred embodiment of the present invention.

As shown in FIGS. 1 and 2, an automated device of the preferred embodiment of the present invention is designed to strip the residual yarn from a yarn tube 1. The automated device comprises a feeding mechanism 100, an index dial 200, a locating mechanism 300, a residual yarn removing mechanism 400, a static removing mechanism 500, a suction mechanism 600, a compressing mechanism 700, and an arranging mechanism 800.

Figure 3:
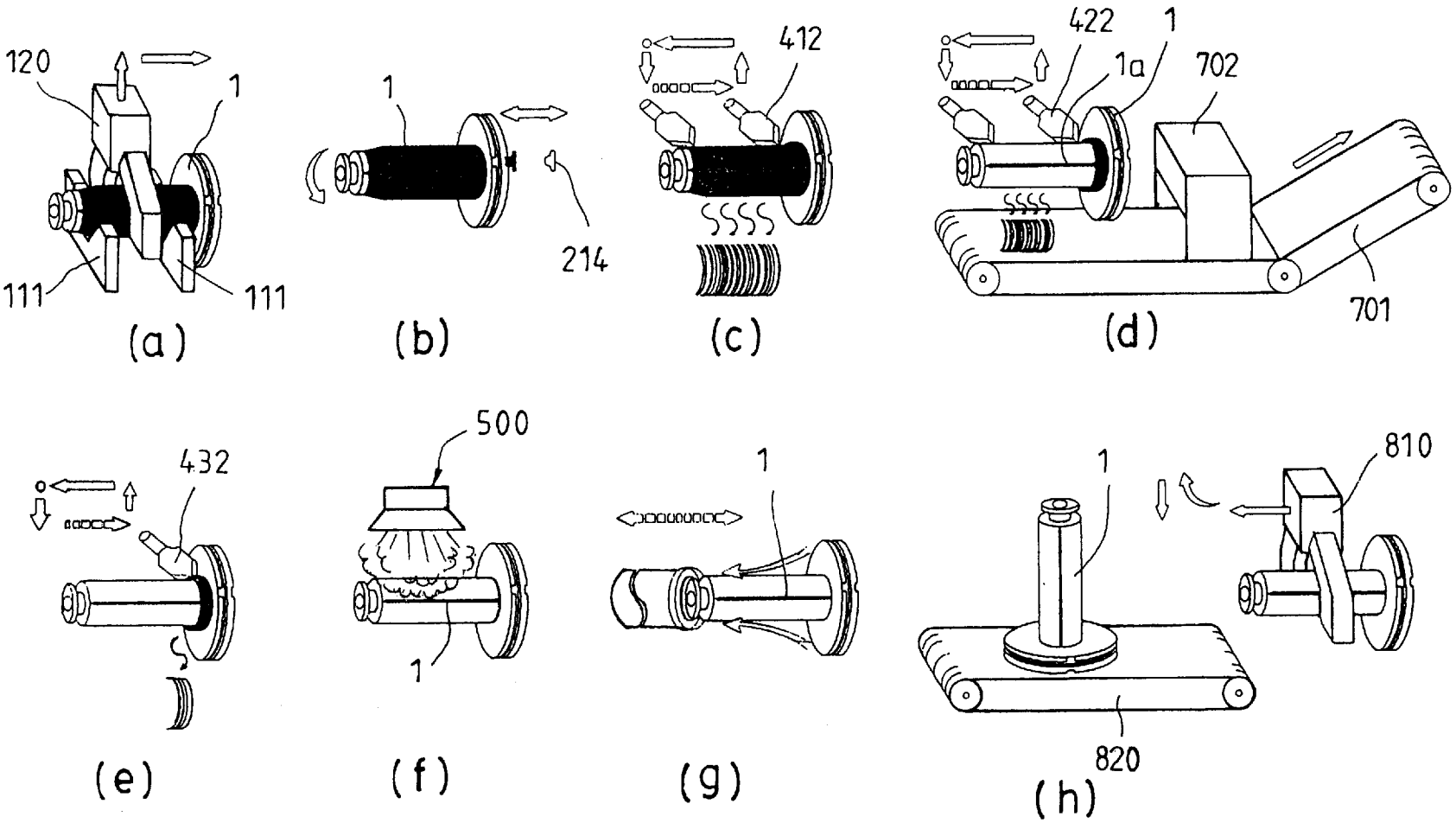
FIG. 3 shows a schematic process flow of the preferred embodiment of the present invention.

As shown in FIG. 3, the step (a) is an automatic feeding process. The step (b) is a yarn tube locating process. The step (c) is a first yarn-cutting process. The step (d) is a second yarn-cutting process. The step (e) is a third yarn-cutting process. The step (f) is a process of removing static. The step (g) is a process of removing the yarn residue by suction. The step (h) is an automatic output process. It must be noted here that the locating mechanism 300 and the residual yarn removing mechanism 400 are not the inventive features of the present invention.

Figures 4, 5:
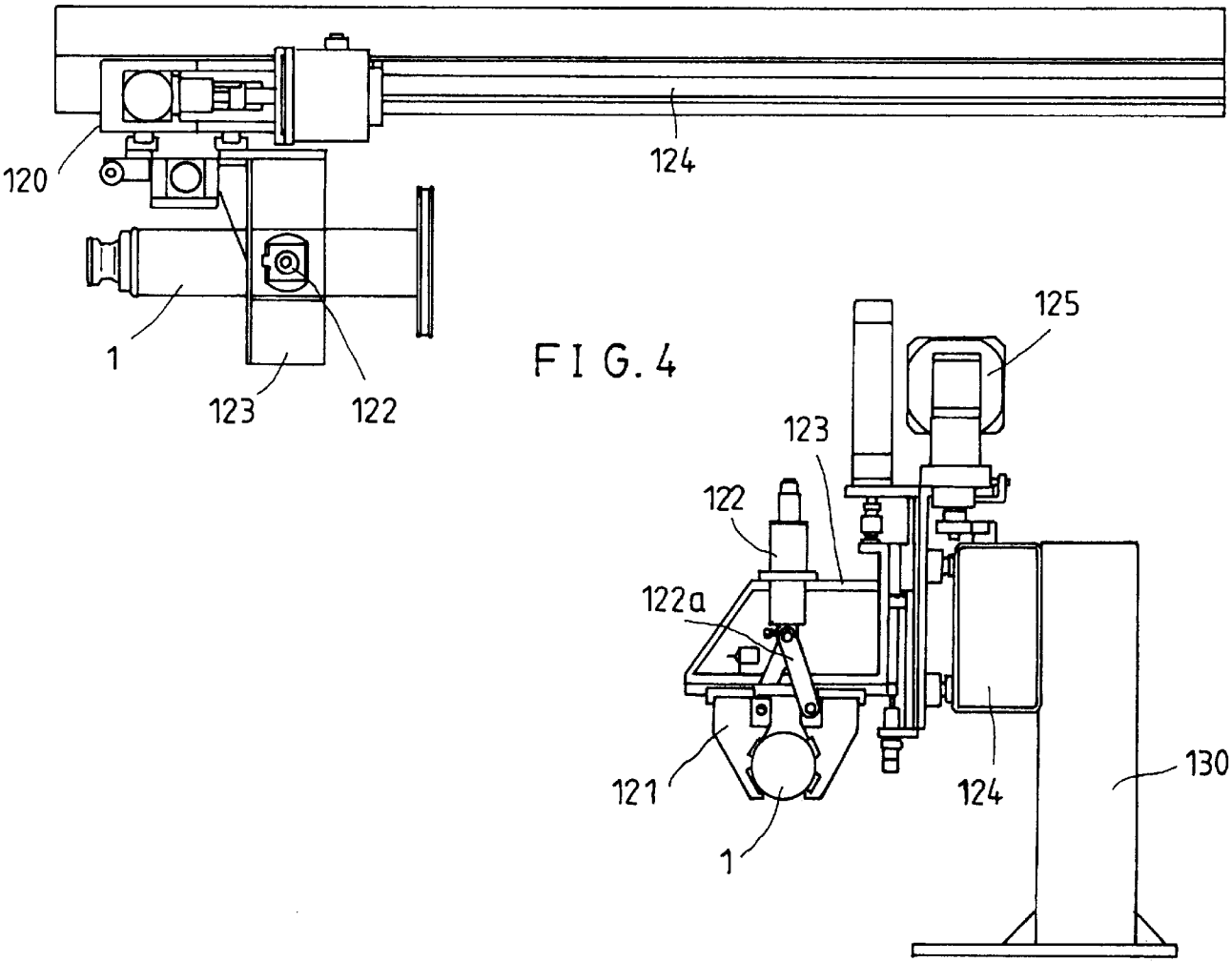
FIG. 4 shows a top view of the first mechanical arm of the preferred embodiment of the present invention.
FIG. 5 shows a front view of the first mechanical arm of the preferred embodiment of the present invention.

The feeding mechanism 100 has a rotary tray 110 and a first mechanical arm 120. A plurality of the yarn tubes 1 are to be stripped by the device of the present invention and are fed into the device such that they are held equidistantly and horizontally in the rotary tray 110, and that each of the yarn tubes 1 is located by two locating blocks 111. The first mechanical arm 120 is mounted over one side of the rotary tray 110 by a support frame 130, as shown in FIGS. 4 and 5. The first mechanical arm 120 comprises a clamping claw 121, a fetching unit 122, a slide seat 123, and a line rail 124 disposed horizontally on the support frame 130. The slide seat 123 is driven by a motor 125 to slide back and forth along the line rail 124. The fetching unit 122 is mounted on the slide seat 123 and is provided with two action rods 122*a* which are fastened with the clamping claw 121. The clamping claw 121 is driven by the fetching unit 122 to slide vertically to catch and release the yarn tube 1. Located in the proximity of the rotary tray 110 are a number of yarn tubes 1 which are stored temporarily so as to be loaded into the rotary tray 110.

The index dial 200 is driven to turn by a servomotor 201 and is provided with eight sets of yarn tube clamping tools 210 which are arranged equidistantly. The yarn tubes 1 have a bottom end which is larger in diameter and is caught by the yarn tube clamping tool 210 such that three clamping heads 211 of the front end of the yarn tube clamping tool 210 extend into the yarn tube 1. Now referring to FIGS. 6 and 7, the three clamping heads 211 are provided with a protective jacket 212 to prevent the yarn tube 1 from being damaged by the clamping head 211. The yarn tube clamping tool 210 is provided at the front end with two rollers 213 and a locating member 214. The index dial 200 is provided with a plurality of yarn residue sweepers 215 which are located under the yarn tube clamping tool 210.

The yarn tubes 1 have a top end which is smaller in diameter than the bottom end thereof and is caught by a clamp 310 of the locating mechanism 300 at the time when the yarn tube clamping tool 210 is switched from the first position (FIG. 3*a*) to the second position (FIG. 3*b*). As the yarn tube 1 is released by the clamping head 211, the yarn tube 1 is turned. In the meantime, the yarn tube 1 is pushed by the rollers 213. The yarn tube 1 is securely located at the time when one of the longitudinal slots 1*a* of the yarn tube 1 is engaged with the locating member 214. The yarn tube 1 is ready to be stripped by the residual yarn removing mechanism 400 comprising a first remover 410 located at the third position (FIG. 3*c*) of the yarn tube clamping tool 210, a second remover 420 located at the fourth position (FIG. 3*d*) of the clamping tool 210, and a third remover 430 located at the fifth position (FIG. 3*e*) of the clamping tool 210. The removers 410, 420, and 430 are provided respectively with a small clamp 411, 421, 431, and a cutter 412, 422, 432. The small clamps hold the top end of the yarn tube 1, whereas the cutters strip the residual yarn along the extending direction of the slots 1*a* of the yarn tube 1. The stripping of the residual yarn is done in three stages including a shallow stripping, a deep stripping and a total stripping.

Figure 6:
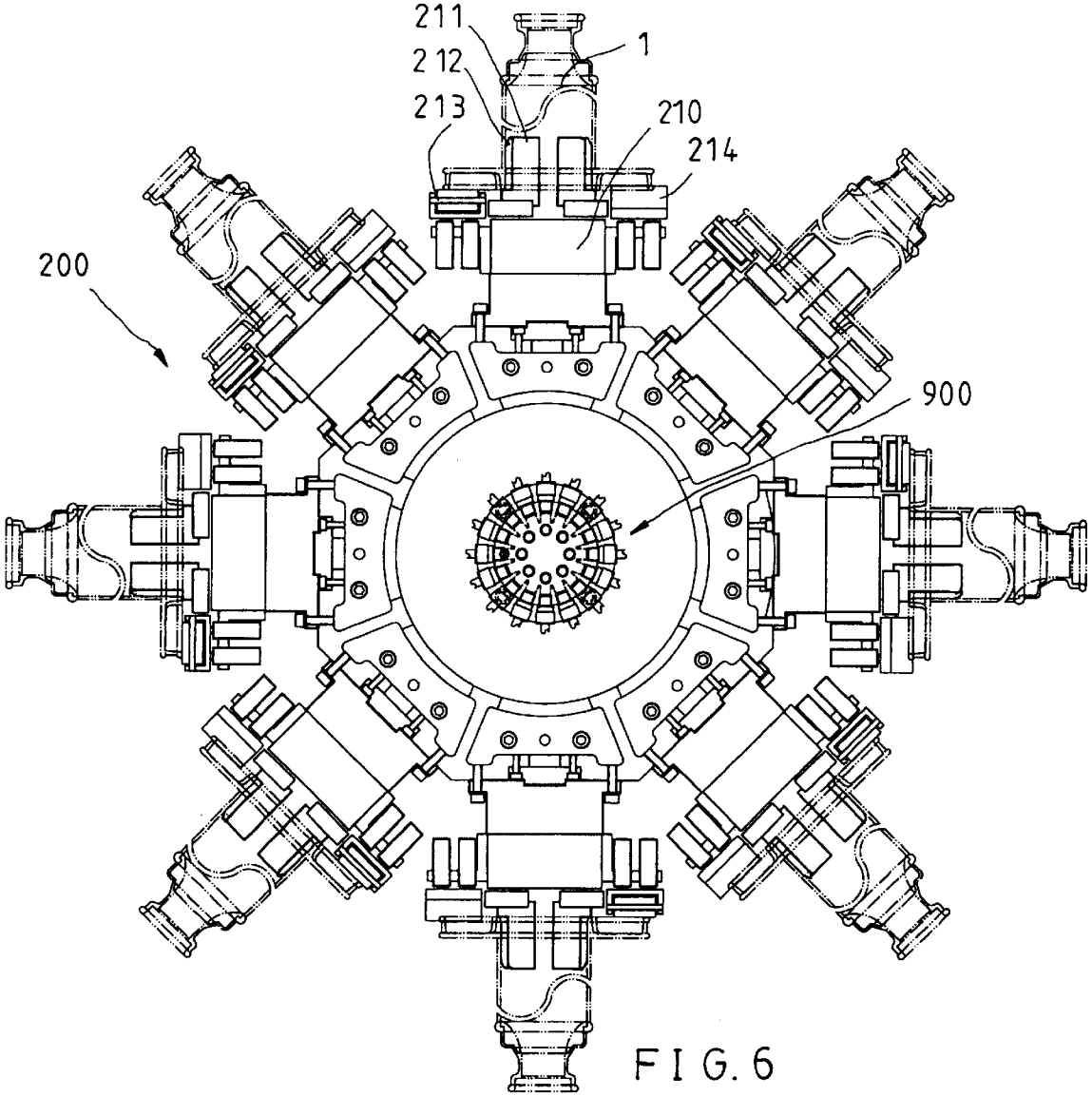
FIG. 6 shows a top view of the index dial of the preferred embodiment of the present invention.
Figure 7:
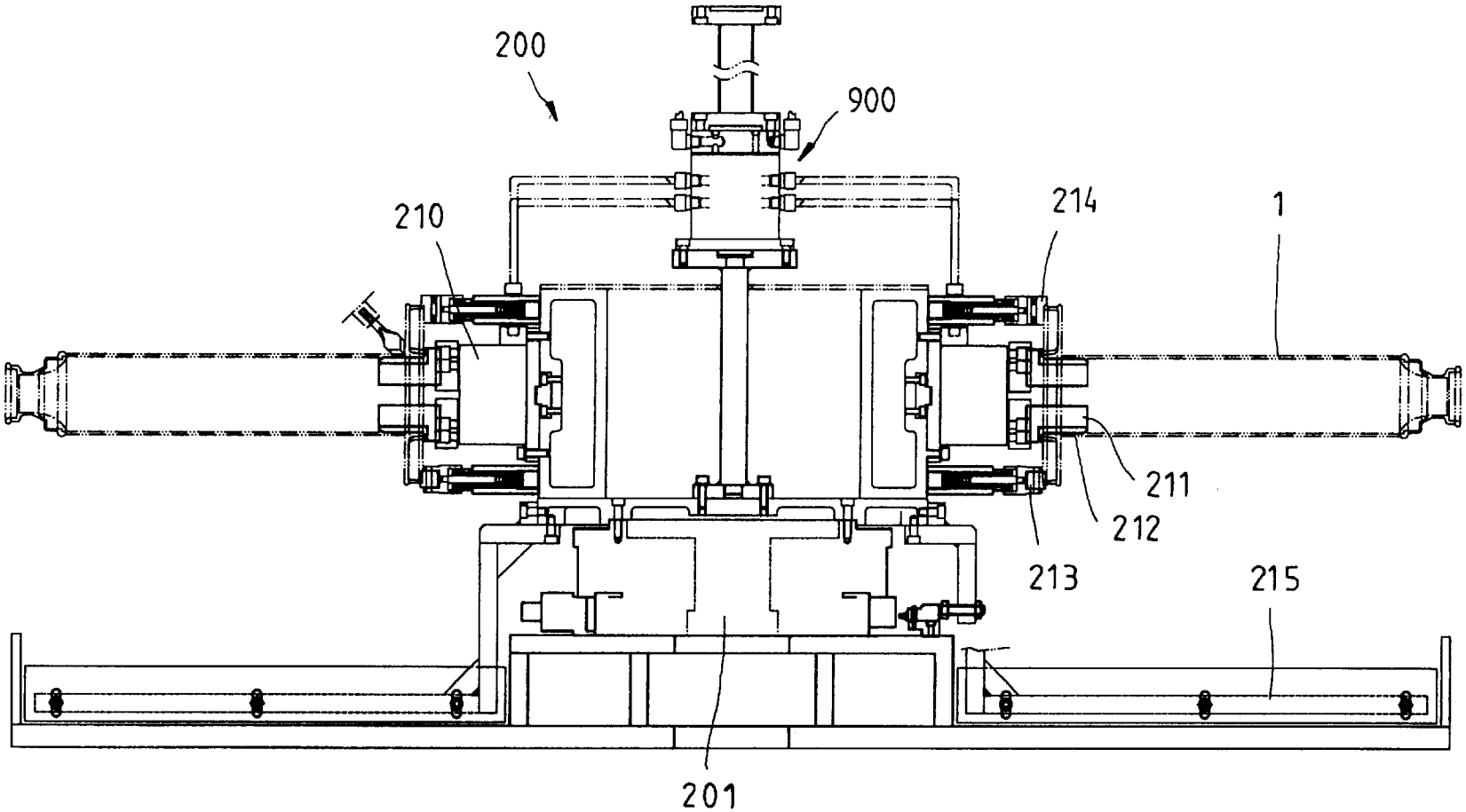
FIG. 7 shows a side view of the index dial of the preferred embodiment of the present invention.
Figure 8:
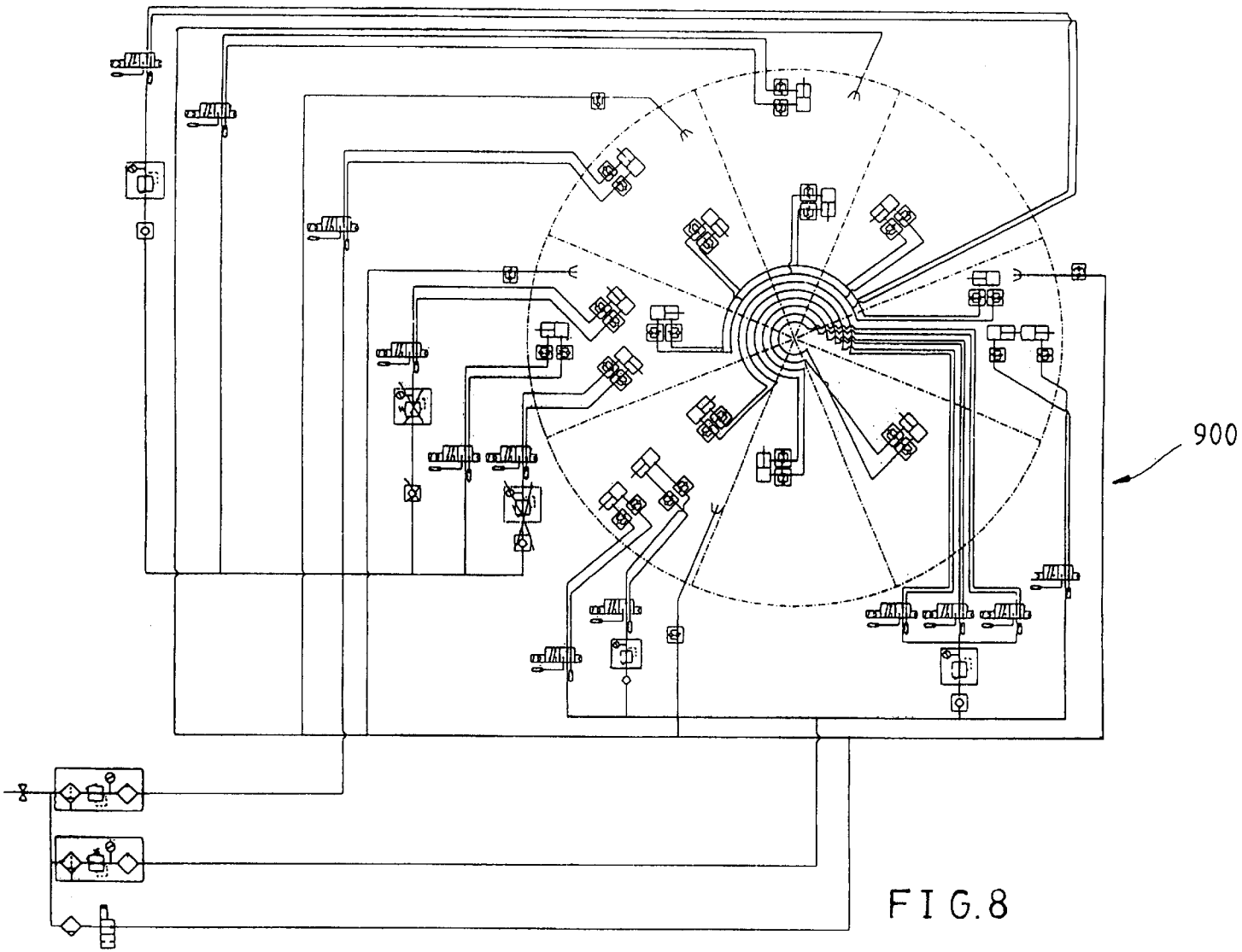
FIG. 8 shows a schematic view of a pressure control device of the preferred embodiment of the present invention in action.

The holding and the releasing actions of the clamping tool 210 of the index dial 200, and the clamps 310, 411, 421, 431 of the locating mechanism 300 and the removing mechanism 400 are all done by a pressure control device 900 which is driven pneumatically and controlled by a logic distribution valve, as shown in FIGS. 6, 7, and 8.

As shown in FIGS. 1 and 9, the static removing mechanism 500 is disposed at the sixth position of the clamping tool 210 and is located over the yarn tube 1 (FIG. 3*f*). The static effect is brought about in the course of removing the residual yarn from the yarn tube 1. The static removing mechanism 500 spreads static ions to eliminate the static. The mechanism 500 is provided with a curtain 501 to confine the static ions.

As shown in FIGS. 1 and 10, the suction mechanism 600 is disposed at the seventh position of the clamping tool 2 and is located at the outer end of the yarn tube 1 (FIG. 3*g*). The mechanism 600 has an expandable rod 610 and a suction tube 620 connected with the expandable rod 610 and a suction device (not shown in the drawings). The suction tube 620 is actuated by the expandable rod 610 to move back and forth to remove the yarn residue.

As shown in FIGS. 1 and 2, the compression mechanism 700 has a conveying belt 701, which is connected with the index dial 200 such that one end of the belt 701 is corresponding in location to a collection port 202 of the index dial 200. The collection port 202 is corresponding in location to the second remover 420 for collecting the residues swept by the yarn sweepers 215. The collected residues are sent by the belt 701 to the compression mechanism 700 in which the residues are compressed. The compression mechanism 700 is provided with a metal detector 701 for detecting the metal impurities which are mixed with the residues.

As shown in FIGS. 1 and 2, the arranging mechanism 800 has a second mechanical arm 810 and a conveying belt 820. The second mechanical arm 810 is supported by a support frame 830 and is provided with a steering unit 811, a clamping claw 812, a slide seat 813, and a line rail 814, as shown in FIGS. 11, 12, and 13. The line rail 814 is mounted on the support frame 830. The slide seat 813 is driven by a motor 815 to slide back and forth on the line rail 814. The steering unit 811 is disposed on the slide seat 813 and is provided with a swiveling member 811*a* capable of being actuated by a pressure cylinder to turn, and a fetching member 811*b* capable of swiveling vertically and horizontally along with the swiveling member 811*a* to actuate the clamping claw 812 to bring about a clamping action at the vertical position, and a releasing action at the horizontal position. This structure takes away a stripped yarn tube 1 from the yarn tube clamping tool 210 at the eighth position. The stripped yam tube 1 is then placed uprightly on the conveying belt 820, as shown in FIG. 3*h*.

In operation, the clamping claw 121 of the first mechanical arm 120 moves horizontally back and forth along the line rail 124 between the rotary tray 110 and the index dial 200. The yarn tube 1 in the rotary tray 110 is taken away by the claw 121 such that the yarn tube 1 is placed horizontally on the clamping tool 210 at the first position. The clamping tool 210 is then switched by the index dial 200 to the second position. The yarn tube 1 is located by the clamp 310 of the locating mechanism 300 and is released by the clamping tool 210. The yarn tube 1 is turned until it is located by the locating member 214. The bottom of the yarn tube 1 is then held by the clamping tool 210. The top end of the yarn tube 1 is released by the clamp 310.

The yarn tube 1 is then proceeded to the removing mechanism 400 in which the yarn tube 1 is stripped in three stages for preventing the cutter from being damaged. Upon completion of the cutting, the cutter is stripped by a blower so as to keep the cutter free from the yarn residue. The yarn residue is swept by the sweepers 215 such that the yarn residue is collected on the conveying belt 701 via the collection port 202. The metal impurities mixed in the yarn residue are detected by the metal detector 702 before the residue is proceeded to the compression mechanism 700.

In the course of stripping the residual yarn by the first, the second, and the third removers 410, 420, and 430, the yarn residue may be attached to the bottom of the yarn tube 1 due to the static. The static removing mechanism 500 is intended to eliminate the static problem. The static residue is removed by the suction mechanism 600 whose suction tube 620 extends to reach the bottom of the yarn tube 1.

The yarn tube 1 is then released by the clamping tool 210 such that the second mechanical arm 810 places the yarn tube 1 uprightly on the conveying belt 820, thanks to the cooperative efforts of the swiveling member 811*a* and the fetching member 811*b*.

What is claimed is:

1. An automated device for stripping residual yarn from a yarn tube, said device comprising:

a feeding mechanism for fetching and transferring a yarn tube having residual yarn;

an index dial provided with a plurality of yarn tube clamping tools for fetching and locating the yarn tube horizontally;

a residual yarn removing mechanism for stripping the residual yarn from the yarn tube;

a suction mechanism for removing yarn residue left over in the stripping of the yarn tube by said removing mechanism; and an arranging mechanism for arranging uprightly the stripped yarn tube.

2. The automated device as defined in claim 1, wherein said feeding mechanism has a rotary tray and a first mechanical arm, said rotary tray being used for keeping yarn tubes to be stripped, said first mechanical arm serving to fetch the yarn tubes from said rotary tray to said yarn tube clamping tools of said index dial.

3. The automated device as defined in claim 2, wherein said first mechanical arm comprises a fetching unit, a clamping claw, a slide seat, and a line rail, said fetching unit being disposed on said slide seat and connected with said clamping claw which is actuated to hold or release the yarn tube vertically, said slide seat being slidably disposed on said line rail such that said slide seat slides back and forth on said line rail.

4. The automated device as defined in claim 1, wherein said arranging mechanism has a second mechanical arm and a conveying belt, said second mechanical arm serving to fetch a stripped yarn tube and to deposit the stripped yarn tube uprightly on said conveying belt.

5. The automated device as defined in claim 4, wherein said second mechanical arm comprises a steering unit, a clamping claw, a slide seat, and a line rail, said steering unit being disposed on said slide seat and provided with a swiveling member and a fetching member whereby said fetching member is actuated by said swiveling member to be in a vertical position so as to cause said clamping claw to clamp the stripped yarn tube and to be in a horizontal position so as to cause said clamping claw to release the stripped yarn tube, said slide seat being slidably disposed on said line rail such that said slide seat slides back and forth on said line rail.

6. The automated device as defined in claim 1 further comprising a compression mechanism for compressing the stripped residual yarn.

7. The automated device as defined in claim 6, wherein said compression mechanism has a metal detector for detecting metal impurities which are mixed in the stripped residual yarn.

8. The automated device as defined in claim 1, wherein said index dial is provided with a plurality of yarn residue sweepers whereby said sweepers are located under said yarn tube clamping tools.

9. The automated device as defined in claim 1, wherein said residual yarn removing mechanism comprises a first remover, a second remover, and a third remover, with each having a clamp and a cutter movable vertically and horizontally.

10. The automated device as defined in claim 9, wherein said first remover, said second remover, and said third remover execute the stripping of a yarn tube such that said clamp holds the top end of the yarn tube, with the bottom end of the yarn tube being held by said yarn tube clamping tool of said index dial.

11. The automated device as defined in claim 10, wherein said clamps of said removers and said yarn tube clamping tools of said index dial are driven pneumatically and controlled by a logic distribution valve.

12. The automated device as defined in claim 1, wherein said yarn tube clamping tools of said index dial are provided at one end with a plurality of clamping heads whereby said clamping heads are inserted into a yarn tube at such time when said yarn tube clamping tool holds the yarn tube.

13. The automated device as defined in claim 1 further comprising a locating mechanism with a clamp for holding a yarn tube while the yarn tube is turned before the yarn tube is proceeded from said index dial to said residual yarn removing mechanism.

14. The automated device as defined in claim 13, wherein said residual yarn clamping tools of said index dial are provided at one end with a plurality of rollers and a locating member whereby said rollers are used to turn the yarn tube which is held by said clamp of said locating mechanism.

15. The automated device as defined in claim 1 further comprising a static removing mechanism for eliminating static of the stripped residual yarn.

16. The automatic device as defined in claim 1, wherein said suction mechanism has an expandable rod and a suction tube fastened with said expandable rod and a suction device.

17. A method for stripping automatically residual yarn from a yarn tube, said method comprising the steps of:

(a) feeding a yarn tube to be stripped;

(b) fetching the yarn tube such that the yarn tube is held horizontally;

(c) removing residual yarn from the yarn tube by a cutter;

(d) compressing the removed piece of residual yarn; and (e) arranging the stripped yarn tube uprightly for storage or transportation.

18. The method as defined in claim 17, wherein the removing of residual yarn from the yarn tube by a cutter in the step (c) is done in three stages whereby said three stages include a shallow stripping, a deep stripping, and a total stripping.

* * * * *